US007092873B2

(12) United States Patent
Engelsberg et al.

(10) Patent No.: US 7,092,873 B2
(45) Date of Patent: Aug. 15, 2006

(54) METHOD OF UPGRADING A DATA STREAM OF MULTIMEDIA DATA

(75) Inventors: Andreas Engelsberg, Hildesheim (DE); Holger Kussmann, Giesen (DE); Michael Wollborn, Hannover (DE); Sven Mecke, Hildesheim (DE); Andre Mengel, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 504 days.

(21) Appl. No.: 10/040,648

(22) Filed: Jan. 7, 2002

(65) Prior Publication Data

US 2002/0128813 A1 Sep. 12, 2002

(30) Foreign Application Priority Data

Jan. 9, 2001 (DE) ..... 01 100 500

(51) Int. Cl.
*G10L 19/00* (2006.01)

(52) U.S. Cl. ..... 704/200.1; 704/260; 704/258

(58) Field of Classification Search ..... 704/260, 704/258, 262, 259, 261, 266, 270, 200.1; 345/619; 379/88.16, 88.14
See application file for complete search history.

(56) References Cited

U.S. PATENT DOCUMENTS 5,682,501 A * 10/1997 Sharman ..... 704/260
5,940,796 A * 8/1999 Matsumoto ..... 704/260
6,593,936 B1 * 7/2003 Huang et al. ..... 345/619
6,600,814 B1 * 7/2003 Carter et al. ..... 379/88.16
6,665,641 B1 * 12/2003 Coorman et al. ..... 704/260

FOREIGN PATENT DOCUMENTS

EP 1 006 453 6/2000

OTHER PUBLICATIONS

Paul Taylor, et al: "SSML: A Speech Synthesis Markup Language", Speech Communication 21, 1997, 00. 123-133.
Amy Isard: "SSML: A Markup Language For . . ." MSC Thesis, Department of Artificial Intelligence, University of Edinburgh, 1995, XP. 002169383.
Eric D. Scheirer et al: "Synthetic and SNHC Audio in . . . " Signal Processing: Image Communication 15, 2000, pp. 445-461 (In English).
"World Wide Web Consortium" (W3C), "Speech Synthesis Markup Language"SSMI, Version 1.0, Copyright 1999-2001; http:www.w3.org/TR/speech-synthesis.

* cited by examiner

*Primary Examiner*—Richemond Dorvil
*Assistant Examiner*—Huyen X. Vo
(74) *Attorney, Agent, or Firm*—Michael J. Striker

(57) ABSTRACT

For upgrading a data stream of multimedia data, which comprises features with textual description, a set of phonetic translation hints is included in the data stream, which specifies the phonetic transcription of parts or words of the textual description. The phonetic transcriptions need not be repeated for each occurrence of a word. This reduces the amount of data necessary for storing or transmitting the description text.

11 Claims, No Drawings

METHOD OF UPGRADING A DATA STREAM OF MULTIMEDIA DATA

BACKGROUND OF THE INVENTION

1. Field of the Invention

The invention describes a method for upgrading a data stream of multimedia data, which comprises features with textual description.

2. Description of the Related Art

In order to exactly describe e.g. the pronunciation of a text, e.g. for controlling a speech synthesizer, the "World Wide Web Consortium" (W3C) is currently specifying a so-called "Speech Synthesis Markup Language" (SSML, http://www.w3.org/TR/speech-synthesis). Within this specification, xml (Extensible Markup Language) elements are defined for describing how the elements of a text are to be pronounced exactly.

For the phonetic transcription of text the "International Phonetic Alphabet" (IPA) is used. The use of this phoneme element together with high-level multimedia description schemes enables the content creator to exactly specify the phonetic transcription of the description text. However, if there are multiple occurrences of the same words in different parts of a description text, the phonetic description has to be inserted (and thus stored or transmitted) for each of the occurrences.

SUMMARY OF THE INVENTION

It is an object of the present invention to provide a method of upgrading a multimedia data stream to include text pronunciation information, which avoids the above-described disadvantage.

It is also an object of the present invention to provide a method, which enables a more efficient phonetic representation of specific parts or words of high-level, textual multimedia description schemes.

This objective is achieved by means of the present invention in that in addition to the textual description a set of phonetic translation hints is included. These phonetic translation hints specify the phonetic transcription of parts or words of the textual description. The phonetic transcription enables applications like speech recognition or text to speech systems to cope with special cases where automatic transcription is not applicable or to completely cut out the process of automatic transcription.

A second aspect of the invention is the efficient binary coding of the phonetic translation hints values in order to allow low bandwidth transmission or storage of respective description data containing phonetic translation hints.

Known solutions allow the phonetic transcription of specific parts or words of the description text for high-level multimedia descriptions. However, the phonetic transcriptions have to be specified for each occurrence of a word or text part, i.e. if certain words occur more than once in a description text, the phonetic transcriptions have to be repeated each time. The present invention has the advantage that it permits specification of a phonetic transcription of specific parts or words of any description text within high-level feature multimedia description schemes. In contrast to the state of the art, the present invention permits specification of the phonetic transcription of words, which are valid for the whole description text or parts of it, without requiring that the phonetic transcription is repeated for each occurrence of the word in the description text. In order to achieve this goal, a set of phonetic translation hints is included in the description schemes. These translation hints uniquely define how to pronounce specific words of the description text. The phonetic translation hints are valid for either the whole description text or parts of it, depending on which level of the description scheme they are included. By this, it is possible to specify (and thus transmit or store) the phonetic transcription of a set of words only once. This phonetic transcription is then valid for all occurrences of those words in that part of the text where the phonetic translation hints are valid. This makes the parsing of the descriptions easier, since the description text no longer carries all the phonetic transcriptions in-line, but they are treated separately. Further, it facilitates the authoring of the description text, since the text can be generated separately from the transcription hints. Finally, it reduces the amount of data necessary for storing or transmitting the description text.

DETAILED DESCRIPTION OF THE INVENTION

Before discussing the details of the invention some definitions, especially those used in MPEG-7, are presented.

In the context of the MPEG-7 standard that is currently under development, a textual representation of the description structures for the description of audio-visual data content in multimedia environments is used. For this task, the Extensible Markup Language (XML) is used, where the Ds and DSs are specified using the so-called Description Definition Language (DDL). In the context of the remainder of this document, the following definitions are used:

Data: Data is audio-visual information that will be described using MPEG-7, regardless of storage, coding, display, transmission, medium or technology.

Feature: A feature is a distinctive characteristic of the data, which signifies something to somebody.

Descriptor (D): A descriptor is a representation of a feature. A descriptor defines the syntax and the semantics of the feature representation.

Descriptor Values (DV): A descriptor value is an instantiation of a descriptor for a given data set (or subset thereof) that describes the actual data.

Description Scheme (DS): A description scheme specifies the structure and semantics of the relationships between its components, which may be both descriptors (Ds) and description schemes (DSs)

Description: A description consists of a DS (structure) and the set of descriptor values (instantiations) that describe the data.

Coded Description: A coded description is a description that has been encoded to fulfill relevant requirements, such as compression efficiency, error resilience, random access, etc.

Description Definition Language (DDL): The description definition language is a language that allows the creation of new description schemes and, possibly, descriptors. It also allows the extension and modification of existing description schemes.

The lowest level of the description is a descriptor. It defines one or more features of the data. Together with the respective DVs it is used to actually describe a specific piece of data. The next higher level is a description scheme, which contains at least two or more components and their relationships. Components can be either descriptors or description schemes. The highest level so far is the description definition language. It is used for two purposes: first, the textual representations of static descriptors and description schemes are written using the DDL. Second, the DDL can also be used to define a dynamic DS using static Ds and DSs.

With respect to the MPEG-7 descriptions, two kinds of data can be distinguished. First, the low level features describe properties of the data like e.g. the dominant color, the shape or the structure of an image or a video sequence. These features are, in general, extracted automatically from the data. On the other hand, MPEG-7 can also be used to describe high-level features like e.g. the title of a film, the author of a song or even a complete media review with respect to the corresponding data. These features are, in general, not extracted automatically, but edited manually or semi-automatically during production or post-production of the data. Up to now, the high level features are described in textual form only, possibly referring to a specified language or thesaurus. A simple example for the textual description of some high level features is given below.

```
<CreationInformation>
    <Creation>
        <Title type="original">
          <TitleText xml: lang="en">Music</TitleText>
        </Title>
        <Creator>
          <Role CSName="MPEG_roles_CS" CSTermID="47">
                <Label xml: lang="en">presenter</Label>
          </Role>
          <Individual>
                <Name >Madonna< /Name>
          </Individual>
        </Creator>
    </Creation>
    <MediaReview>
        <Reviewer>
          <FirstName>Alan</FirstName>
          <GivenName>Bangs</GivenName>
        </Reviewer>
        <RatingCriterion>
          <CriterionName>Overall</CriterionName>
          <WorstRating>1</WorstRating>
          <BestRating>10</BestRating>
        </RatingCriterion>
        <RatingValue>10</RatingValue>
        <FreeTextReview>
          This is again an excellent piece of music from our well-
          known superstar, without the necessity for more than 180
          bpm in order to make people feel excited. It comes along
          with harmonic yet clearly defined transitions between
          pieces of rap-like vocals, well known for e.g. from the Kraut-
          Rappers "Die fantastischen 4" and their former chart
          runner-up "MfG", and on the other hand peaceful sounding
          instrumental sections. Therefore this song deserves a clear
          10+ rating.
        </FreeTextReview>
    </MediaReview>
</CreationInformation>
```

The example uses the XML language for the descriptions. The text in the brackets ("< . . . >") is referred to as XML tags, and it specifies the elements of the description scheme. The text between the tags are the data values of the description. The example describes the title, the presenter and a short media review of an audio track called "Music" from the well-known American Singer "Madonna". As can be seen, all the information is given in textual form, possibly according to a specified language ("de" for German, or "en" for English) or to a specified thesaurus. The text describing the data can in principle be pronounced in different ways, depending on the language, the context or the usual customs with respect to the application area. However, the textual description as specified up to now is the same, regardless of the pronunciation.

In order to exactly describe e.g. the pronunciation of the text, e.g. for controlling a speech synthesizer, the "World Wide Web Consortium" (W3C) is currently specifying a so-called "Speech Synthesis Markup Language" (SSML, http://www.w3.org/TR/speech-synthesis). Within this specification, xml elements are defined for describing how the elements of a text are to be pronounced exactly. Among others, a phoneme element is defined which allows to specify the phonetic transcription of text parts like described below.

```
<phoneme ph="t&#252; m&#251; to&#28A;">tomato</phoneme>
<!--This is an example of IPA using character entities-->
<phoneme ph="tümuto">tomato</phoneme>
<!-This example uses the Unicode IPA characters.-->
<!--Note: this will not display correctly on most browsers.-->
```

As can be seen, for the phonetic transcription the "International Phonetic Alphabet" (IPA) is used. The use of this phoneme element together with high-level multimedia description schemes enables the content creator to exactly specify the phonetic transcription of the description text. However, if there are multiple occurrences of the same words in different parts of a description text, the phonetic description has to be inserted (and thus stored or transmitted) for each of the occurrences.

The broad or general concept of the present invention is to define a new DS called "PhoneticTranslationHints" which gives additional information about how a set of words is pronounced. The current Textual Datatype, which does not include this information, is defined with respect to the MPEG-7 Multimedia Description Schemes CD as follows:

```
<!-- ######################### -->
<!-- Definition of Textual Datatype -->
<!-- ######################### -->
<complexType name="TextualType">
    <simpleContent>
        <extension base="string">
            <attribute ref="xml: lang" use="optional"/>
        </extension>
    </simpleContent>
</complexType>
```

The Textual Datatype only contains a string for text information and an optional attribute for the language of the text. The additional information about how some or all words in an instance of the Textual Datatype are pronounced is given by an instance of the new defined "PhoneticDecriptionHintsType". Two solutions for the definition of this new type are given in the following subsections.

The first embodiment of the "PhoneticTranslationHintsType" is given by the following definition:

```
<complexType name="PhoneticTranslationHintsType">
    <sequence maxOccurs="unbounded">
        <element name="Word">
            <complexType>
                <simpleContent>
                    <extension base="string">
                      <attribute name="phonetic_translation"
                      type="string" use=" required"/>
                    </extension>
                </simpleContent>
            </complexType>
        </element>
    </sequence>
</complexType>
```

TABLE I

| Semantics of "PhoneticTranslationHintsType" Version 1 | |
|---|---|
| Name | Definition |
| PhoneticTranslationHints | Contains a set of words and their corresponding pronunciations. |
| Word | Single word coded as string. |
| Phonetic__translation | This element contains the additional phonetic information about the corresponding text. For the representation of the phonetic information, the IPA (International Phonetic Alphabet) or the SAMPA representation is chosen. |

This newly created type unambiguously gives a connection between words and their appropriate pronunciation. In the following, an example with an instance of the "PhoneticTranslationHintsType" is given which refers to the example discussed before.

```
<PhoneticTranslationHints>
    <Word phonetic__translation= "b&#152; p&#211; mi&#28A;
    n&#043">
    bpm</Word>
    <Word phonetic__translation= "kr&#372; r&#011; pe&#290;">
    Kraut-Rappers</Word>
    <Word phonetic__translation= "em&#001; ef&#005; g&#011;">
    MFG</Word>
</PhoneticTranslationHints>
```

With this example of the "PhoneticTranslationHintsType" an application now knows the exact phonetic transcription of some or all words of the text, which is given between the <FreeTextReview> tags in the example discussed before.

A second embodiment of the "PhoneticTranslationHintsType" is given by the following definition.

```
    <complexType name ="PhoneticTranslationHintsType">
        <sequence maxOccurs="unbounded">
            <element name="Word" type="string"/>
            <element name="PhoneticTranslation"/>
        </sequence>
    </complexType>
```

The semantics of the newly defined "PhoneticTranslationHintsType", which are the same as in the version 1 described in the previous section, are specified in the following table.

TABLE II

| Semantics of "PhoneticTranslationHintsType" Version 2 | |
|---|---|
| Name | Definition |
| PhoneticTranslationHints | Contains a set of words and their corresponding pronunciations. |
| Word | Single word coded as string. |
| Phonetic_translation | This element contains the additional phonetic information about the corresponding text. For the representation of the phonetic information, the IPA (International Phonetic Alphabet) or the SAMPA representation is chosen. |

In the following, an example of the "PhoneticTranslationHintsType" Version 2 is given, which refers again to the example discussed before.

```
<PhoneticTranslationHints>
    <Word>bpm< /Word>
    <phonetic__translation> b&#152; p&#211; mi&#28A; n&#043
    </Phonetic__translation>
    <Word>Kraut-Rappers< /Word>
    <phonetic__translation>kr&#372; r&#011; pe&#290;
    </phonetic__translation>
    <Word>MFG</Word>
    <phonetic__translation> em&#001; ef&#005; g&#011;
    </phonetic translation>
</PhonetictranslationHints>
```

With this new definition of the "PhoneticTranslationHintsType" an example of this type consists of the tags <Word> and <PhoneticTranslation> which always correspond to each other and build one unit that describes a text and its associated phonetic transcription.

The phonemes used in the above-described phonetic translation hints DSs are in general described also as printable characters using UNICODE presentation. However, in general the set of phonemes that is used will be restricted to a limited number. Therefore, for more efficient storage and transmission a binary fixed length or variable length code representation can be used for the phonemes, which eventually takes into account the statistics of the phonemes.

The additional phonetic transcription information is necessary for a huge number of applications, which include a TTS functionality or speech recognition system. In fact the speech interaction with any kind of multimedia system is based on a single language, normally the native language of the user. Therefore the HMI (the known vocabulary) is adapted to this language. Nevertheless, the words which are used from the user or which should be presented to the user can also include terms of another language. Thus, the TTS system or speech recognition does not know the right pronunciation for these terms. Using the proposed phonetic description solves this problem and makes the HMI much more reliable and natural.

A multimedia system providing content of any kind to the user needs such phonetic information. Any additional text information about the content can include technical terms, names or other words needing special pronunciation information to present it to the user via TTS. The same holds for news, emails or other information, which should be read to the user.

Especially a film or music storage device, which can be a CD, CD-ROM, DVD, MP3, MD or any other device, contains a lot of films and songs with a title, actor name, artist name, genre, etc. The TTS system does not know how to pronounce all these words and the speech recognition cannot recognize such words. If the user, for example, wants to listen to pop music and the multimedia system should give a list of available pop music via TTS, it would not be able to pronounce the found CD titles, artist names or song names without additional phonetic information.

If the multimedia system should present (via text-to-speech interfaces (TTS)) a list of the available film or music genres, it also needs this phonetic transcription information. The same also holds for the speech recognition to better identify corresponding elements of the textual description.

Another application is the radio (via FM, DAB, DVB, RDM, etc.). If the user wants to listen to the radio and the system should present a list of the available programs, it would not be possible to pronounce the programs, because the radio programs have names like "BBC", or "WDR".

Others have a name using normal words like "Antenne Bayern" and some names are a mixture of both, e.g. "N-Joy".

The telephone application often provides a telephone book. Even in this case without phonetic transcription information the system cannot recognize or present the names via TTS, because it does not know how to pronounce it.

So any functionality or application which presents information to the user via TTS or which uses a speech recognition needs a phonetic transcription for some words.

Optionally it is possible to transmit the reference on any given alphabet, which is used to represent the phonetic element.

The translation hints together with the corresponding elements of the textual description can be implemented in text-to-speech interfaces, speech recognition devices, navigation systems, audio broadcast equipment, telephone applications, etc., which use textual description in combination with phonetic transcription information for search or filtering of information.

The disclosure in German Patent Application 01 100 500.6 of Jan. 9, 2001 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method of upgrading a data stream of multimedia data, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A method of upgrading a data stream of multimedia data, said data stream comprising features with a textual description, said textual description comprising a plurality of words, said method comprising the steps of:

a) including a set of phonetic translation hints in the data stream of the multimedia data in addition to the textual description, wherein each of said phonetic translation hints comprises a repeated word of the textual description and a phonetic transcription of said repeated word, and each of said phonetic translation hints is provided only once in said data stream, wherein said phonetic transcription of said repeated word determines pronunciation of said repeated word and is valid for said textual description without requiring repetition of said phonetic transcription hint for said repeated word at each occurrence of said repeated word in said textual description; and b) using each of said phonetic transcription hints provided in the data stream to define pronunciation of said repeated word associated therewith at each occurrence of said repeated word in said textual description.

2. The method according to claim 1, wherein said phonetic translation hints are embedded in an MPEG data stream associated with textual type descriptors.

3. The method according to claim 2, whereIn said MPEG data stream is an MPEG-7 data stream.

4. The method according to claim 1, further comprising referring to an alphabet in a predetermined format for representation of phonetic transcription information.

5. The method according to claim 4, wherein said alphabet is an international phonetic alphabet or SAMPA.

6. The method according to claim 1, wherein said phonetic translation hints include a limited number of phonemes.

7. The method according to claim 6, wherein said phonemes are represented with a binary fixed length or variable length code.

8. The method according to claim 7, wherein coding of said phonemes takes into account statistics of the phonemes.

9. The method according to claim 1, further comprising storing said phonetic translation hints in a speech recognition system to better identify corresponding elements of the textual description.

10. The method according to claim 9 wherein the phonetic translation hints together with the corresponding elements of the textual description are implemented in text-to-speech interfaces, speech recognition devices, navigation systems, audio broadcast equipment or telephone applications, in which said textual description is used In combination with phonetic information for search or filtering of information.

11. A method of upgrading a data stream of multimedia data, said data stream comprising features with a textual description, said textual description comprising a plurality of words including a repeated word, said method comprising the steps of:

a) specifying at least a part of said textual description in which said repeated word is repeated at least once;

b) providing a phonetic translation hint for said repeated word only once in said data stream, wherein said phonetic translation hint comprises said repeated word and a phonetic transcription of said repeated word, said phonetic transcription defining pronunciation of said repeated word, so that said phonetic translation hint is not repeated in said at least a part of said textual description at each occurrence of said repeated word, for which the phonetic transcription is given: and c) using said phonetic transcription provided in said phonetic translation hint to define pronunciation of said repeated word at each occurrence of said repeated word in said at least a part of said textual description.

* * * * *